US009099793B2

(12) United States Patent
Matsushita et al.

(10) Patent No.: US 9,099,793 B2
(45) Date of Patent: Aug. 4, 2015

(54) CRIMPING STRUCTURE OF TERMINAL TO ELECTRICAL CABLE

(71) Applicant: YAZAKI CORPORATION, Tokyo (JP)

(72) Inventors: Kouichiro Matsushita, Makinohara (JP); Tadahisa Sakaguchi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 45 days.

(21) Appl. No.: 13/932,374

(22) Filed: Jul. 1, 2013

(65) Prior Publication Data

US 2014/0004757 A1 Jan. 2, 2014

(30) Foreign Application Priority Data

Jul. 2, 2012 (JP) ..... 2012-148431

(51) Int. Cl.
*H01R 4/10* (2006.01)
*H01R 4/18* (2006.01)
*H01R 4/62* (2006.01)

(52) U.S. Cl.
CPC ..... *H01R 4/184* (2013.01); *H01R 4/188* (2013.01); *H01R 4/185* (2013.01); *H01R 4/62* (2013.01)

(58) Field of Classification Search
USPC ..... 439/877, 882
See application file for complete search history.

(56) References Cited

U.S. PATENT DOCUMENTS 3,955,044 A * 5/1976 Hoffman et al. ..... 174/84 C
8,177,590 B2 * 5/2012 Tanaka et al. ..... 439/877
8,221,171 B2 * 7/2012 Ono et al. ..... 439/877
8,303,354 B2 * 11/2012 Ootsuka et al. ..... 439/877
8,519,267 B2 * 8/2013 Peters et al. ..... 174/77 R
2009/0130923 A1 5/2009 Kuwayama (Continued)

FOREIGN PATENT DOCUMENTS

CN 101842939 A 9/2010
JP 2009-181777 A 8/2009
JP 2012-38487 A 2/2012

OTHER PUBLICATIONS

Office Action dated Mar. 31, 2014 issued by the Korean Intellectual Property Office in corresponding Korean Application No. 10-2013-0077063.
Office Action dated Oct. 28, 2014, issued by the Korean Intellectual Property Office in counterpart Korean Application No. 10-2013-0077063.

(Continued)

*Primary Examiner* — Hien Vu
(74) *Attorney, Agent, or Firm* — Sughrue Mion, PLLC

(57) ABSTRACT

A conductive metal terminal includes a conductor holding part that holds a conductor of a electrical cable at a distal end side of the conductive metal terminal and a sheath holding part that holds a sheath at a proximal end side of the conductive metal terminal. The conductor holding part includes a bottom plate on which the conductor of the aluminum electrical cable is placed and a pair of conductor crimping pieces. The sheath holding part includes a bottom plate adjacent to the bottom plate of the conductor holding part and a pair of sheath crimping pieces. The conductor holding part further includes an indent formed in a semi-cylindrical shape and extending from one of the conductor holding part to the other of the conductor holding part. The conductor holding part further includes circular-shaped serrations which are closer to the distal end side than the indent.

6 Claims, 8 Drawing Sheets

(56) References Cited

U.S. PATENT DOCUMENTS

| | | | |
|---|---|---|---|
| 2010/0261391 | A1 | 10/2010 | Ono et al. |
| 2013/0137315 | A1 | 5/2013 | Onuma et al. |

OTHER PUBLICATIONS

Communication dated Apr. 7, 2015 issued by the State Intellectual Property Office of the People's Republic of China in counterpart Chinese Application No. 201310276023.0.

* cited by examiner

CRIMPING STRUCTURE OF TERMINAL TO ELECTRICAL CABLE

CROSS REFERENCE TO RELATED APPLICATION

This application is based on Japanese Patent Applications No. 2012-148431 filed on Jul. 2, 2012, the contents of which are incorporated herein by reference.

BACKGROUND OF THE INVENTION

1. Technical Field

The present invention relates to a crimping structure for attaching an electrical cable to a terminal, and more particularly to a crimping structure of a terminal to an electrical cable, in which the electrical cable having a conductor formed of an aluminum or an aluminum alloy is attached to the terminal, and when the electrical cable is pulled so that a force of detaching the electrical cable from the terminal is exerted thereon, the aluminum electrical cable can be prevented from being easily disconnected.

2. Background Art

In general, copper electrical cables are used for wire harnesses to be wired in vehicles, such as an automobile. When the wire harnesses are connected with each other or in-vehicle devices, a terminal is attached to the copper electrical cables of the wire harnesses. This type of terminal is generally attached to the copper electrical cables by crimping.

The terminal crimped on the copper electrical cable generally includes a bottom plate adapted to allow a conductor of the copper electrical cable, which is formed by twisting a plurality of copper wires together, to be placed thereon, and a pair of conductor caulking pieces provided to be continuous to the bottom plate and thus to allow the conductor placed on the bottom plate to be sandwiched therebetween.

The pair of conductor caulking pieces is adapted such that, by inwardly crimping the conductor caulking pieces, the conductor of the copper electrical cable is sandwiched between the bottom plate and the conductor caulking pieces, and, by sandwiching in this way, the terminal is crimped on the conductor of the copper electrical cable.

In recent years, use of an aluminum electrical cable instead of the copper electrical cable has been studied in consideration of weight reduction of vehicles and easy recycling of material, in addition to the lack of copper resources. However, the aluminum has a thick oxide film formed on a surface thereof, as compared to the copper, and in a case of the aluminum electrical cable, a contact resistance between the conductor and the terminal tends to be relatively high.

To reduce the contact resistance between the conductor and the terminal, a method is employed, in which each of the conductor caulking pieces of the terminal is strongly caulked on the conductor so that a compression ratio of the conductor is increased. According to this method, the oxide film on each of wires constituting the conductor is broken by strongly caulking the conductor, thereby achieving a reduction of the contact resistance between the conductor and the terminal.

As used herein, the compression ratio of the conductor is a ratio of a cross-sectional area of the conductor after compression to a cross-sectional area of the conductor before compression.

As the compression ratio of the conductor is increased, a stress applied to the conductor is also increased. Accordingly, in the case of the aluminum which is inferior in mechanical strength to the copper, a crimping strength of the terminal is significantly reduced if an excessive stress is applied to the conductor.

Therefore, with respect to crimping the terminal to the aluminum electrical cable, a crimping structure of a terminal to an electrical cable has been proposed, in which the reduction of the contact resistance between the conductor and the terminal can be compatible with ensuring of the crimping strength of the terminal (for example, see JP-A-2009-181777).

According to the crimping structure disclosed in JP-A-2009-181777, a terminal 10 includes a bottom plate 20 adapted to allow a conductor 2 of an aluminum electrical cable 1 to be placed thereon, and a pair of conductor caulking pieces 21 provided to be continuous to the bottom plate 20 and also to allow the conductor 2 on the bottom plate 20 to be sandwiched and caulked therebetween. The conductor 2 is disposed on the bottom plate 21 between the pair of conductor caulking pieces 21 and is sandwiched between the pair of conductor caulking pieces 21 and the bottom plate 20 by crimping the pair of conductor caulking pieces 21. Also, a protruded portion 24 is provided to be located toward a distal end of a crimped portion of the crimped conductor 2. A caulking height H from the bottom plate 20 to the conductor caulking pieces 21 is substantially constant throughout the entire width of the conductor caulking pieces. Therefore, the crimped portion is more strongly compressed against the protruded portion 24 by the conductor caulking pieces 21 at a distal end side of the conductor 2 than at a proximal end side thereof.

Also, in the crimping structure disclosed in JP-A-2009-181777, a plurality of serrations (shallow grooves) 25 are provided at a rear of the protruded portion 24 on the bottom plate 20 of the conductor holing part 13 to be extended in parallel to each other in a direction perpendicular to an axis direction (i.e., a longitudinal direction of the terminal 10) of the crimped portion of the conductor 2. Thus, the protruded portion 24 is disposed at front of the location where the serrations 25 are provided.

According to the crimping structure disclosed in JP-A-2009-181777, while the caulking height of the whole of the conductor caulking pieces is managed to be substantially constant, a compression ratio of the conductor at a front location where the protruded portion exists can be set higher and a compression ratio of the conductor at a rear location where the protruded portion does not exists can be set lower. Accordingly, an electrical connection ability can be maintained high in a front part having a high compression ratio and a terminal holding force can be maintained high in a rear part having a low compression ratio.

However, JP-A-2009-181777 has problems in that, when core wires of the conductor formed by twisting a plurality of aluminum or aluminum alloy wires together are excessively compressed, the conductor is damaged by corners of the serrations, thereby decreasing a fixing strength, and as a result, when the aluminum electrical cable is pulled, elongation of the conductor of the aluminum electrical cable is small, thereby causing the conductor to be prematurely disconnected or the like.

Also, a terminated aluminum electrical cable, in which a terminal is attached to an aluminum electrical cable, can be used in various environments, and thus a thermal shock test is performed thereto. The thermal shock test is a test intended to evaluate a product by a sudden change in temperature (thermal shock), in which a high temperature and a low temperature are alternately and repeatedly applied to a test product in a short time to cause a sudden change of environmental temperature, thereby evaluating the reliability of the test product.

In the thermal shock test as described above, due to difference in expansion coefficient in a portion where different materials are caulked, a small gap is created between the conductor of the aluminum electrical cable and the bottom plate and the conductor caulking pieces of the terminal by expansion and contraction according to temperature changes. Therefore, there is a case where the conductor of the aluminum electrical cable plays in the conductor caulking pieces.

Because the conductor of the aluminum electrical cable plays in the conductor caulking pieces as described above, there is a problem in that core wires of the conductor, which is formed by twisting a plurality of aluminum or aluminum alloy wires together and is caulked by the conductor caulking pieces, are subject to damage, such as scars, by corners of the serrations, thereby decreasing the fixing strength.

Accordingly, the present invention has been made keeping in mind the above problems, and an object of the invention is to provide a crimping structure of a terminal to an electrical cable, in which, when the electrical cable is pulled so that a force cable of detaching the electrical cable from the terminal is exerted thereon, a stress due to corners of serrations can be prevented from being directly applied thereto, and thus, due to a strain relief effect or a dispersion effect, the conductor of the aluminum electrical cable can be prevented from being easily disconnected.

SUMMARY OF THE INVENTION (1) According to an aspect of the invention, a crimping structure of a conductive metal terminal in which the conductive metal terminal is connected to an aluminum electrical cable including a conductor formed by twisting a plurality of aluminum or aluminum alloy wires and a sheath made of an insulating material and covering on an outer circumference of the conductor, by crimping the conductive metal terminal on the aluminum electrical cable, includes a conductor holding part that holds the conductor of the aluminum electrical cable at a distal end side of the conductive metal terminal, and a sheath holding part that holds the sheath of the aluminum electrical cable at a proximal end side of the conductive metal terminal. The conductor holding part includes a bottom plate on which the conductor of the aluminum electrical cable is placed and a pair of conductor crimping pieces provided to be continuous to the bottom plate and sandwich the conductor on the bottom plate of the conductor holding part. The sheath holding part includes a bottom plate adjacent to the bottom plate of the conductor holding part and on which the sheath is placed, and a pair of sheath crimping pieces provided to be continuous to the bottom plate of the sheath holding part and sandwich the sheath on the bottom plate of the sheath holding part. The conductor holding part further includes an indent on a sheath holding part side of the conductor holding part and formed in a semi-cylindrical shape, the indent extending from one of the conductor holding part to the other of the conductor holding part through the bottom plate of the conductor holding part and being perpendicular to an axis direction of the crimped conductor of the aluminum electrical cable. The conductor holding part further includes circular-shaped serrations on an upper surfaces of the bottom plate of the conductor holding part and the pair of conductor caulking pieces. The circular-shaped serrations is closer to the distal end side of the conductive metal terminal than the indent.

(2) In the crimping structure of (1), the conductor holding part further includes a second indent extending from one of the conductor holding part to the other of the conductor holding part through the bottom plate of the conductor holding part and being perpendicular to the axis direction of the crimped conductor of the aluminum electrical cable, and the circular-shaped serrations are disposed between the indent and the second indent.

(3) In the crimping structure of (1) or (2), wherein heights of the indent and the second intend are 0.03 mm to 0.08 mm.

(4) In the crimping structure of any one of (1) to (3), the circular-shaped serrations are arranged in a zigzag pattern.

According to the present invention as set forth in (1), even if core wires of the conductor formed by twisting a plurality of aluminum or aluminum alloy wires together are excessively compressed, the core wires of the conductor are not scarred by corners of the serrations, thereby preventing the core wires of the conductor from being damaged and also preventing a decrease in a fixing strength. Also, when the aluminum electrical cable is pulled by a certain cause so that a force is directly exerted on the conductor of the aluminum electrical cable, elongation of the conductor of the aluminum electrical cable can be obtained by a stress relief effect due to the indent and a dispersion effect due to the serrations, thereby increasing the fixing strength (tensile load).

In addition, according to the present invention as set forth in (1), even when the conductor of the aluminum electrical cable plays in the conductor caulking pieces of the terminal due to a thermal shock test, elongation of the conductor of the aluminum electrical cable can be obtained by the stress relief effect due to the indent and the dispersion effect due to the serrations, thereby increasing the tensile load.

According to the present invention as set forth in (2), in addition to the indent, the second indent is further provided so that serrations are disposed therebetween, and the second indent is formed in a semi-cylindrical shape on distal end sides of the pair of conductor caulking pieces and is extended from the one conductor caulking piece through the bottom plate to the other conductor caulking piece to be perpendicular to the axis direction of the crimped portion of the conductor of the aluminum electrical cable. Therefore, even if core wires of the conductor formed by twisting a plurality of aluminum or aluminum alloy wires together are excessively compressed, the core wires of the conductor are not scarred by corners of the serrations, thereby preventing the core wires of the conductor from being damaged and also preventing a decrease in the fixing strength. In addition, when the aluminum electrical cable is pulled, a further enhanced strain relief effect can be obtained by two indents, and also by the stress relief effect and the dispersion effect due to the serrations, elongation of the conductor of the aluminum electrical cable can be obtained, thereby increasing the fixing strength (tensile load).

Furthermore, according to the present invention as set forth in (2), even when the conductor of the aluminum electrical cable plays in the conductor caulking pieces of the terminal due to a thermal shock test, a further enhanced strain relief effect can be obtained by two indents, and also by the stress relief effect and the dispersion effect due to the serrations, elongation of the conductor of the aluminum electrical cable can be obtained, thereby preventing the conductor from being prematurely broken.

According to the present invention as set forth in (3), heights of the indents are set to 0.03 mm to 0.08 mm, and thus contacts by the indents and the strain relief effect of preventing a force from being exerted on the cable can be optimally maintained. Namely, by setting the heights of the indents to 0.03 mm to 0.08 mm, an optimal tensile strength can be ensured.

Here, the reason that the heights of the indents are set to 0.03 mm or more is because, if the heights of the indents are set to 0.03 mm, when each of the conductor caulking pieces of the terminal is strongly caulked on the conductor, a decrease in a compression ratio of the conductor can be inhibited and also an oxide film on each of wires constituting the conductor of the electrical cable can be broken to achieve a reduction of a contact resistance between the conductor and the terminal, but the strain relief effect cannot be obtained.

Also, the reason that the heights of the indents are set to 0.08 mm or less is because, if the heights of the indents is more than 0.08 mm, the strain relief effect can be sufficiently obtained, but when each of the conductor caulking pieces of the terminal is strongly caulked on the conductor, a decrease in the compression ratio of the conductor cannot be inhibited and also a reduction of a contact resistance between the conductor and the terminal obtained by breaking an oxide film on each of wires constituting the conductor of the electrical cable cannot be achieved.

According to the present invention as set forth in (4), by arranging the circular-shaped serrations in a zigzag pattern, even if core wires of the conductor formed by twisting a plurality of aluminum or aluminum alloy wires together are excessively compressed, the core wires of the conductor are not scarred by corners of the serrations even when the aluminum electrical cable is pulled by a certain cause so that a force is directly exerted on the conductor of the aluminum electrical cable, thereby sufficiently exhibiting the strain relief effect.

In addition, according to the present invention as set forth in (4), by arranging the circular-shaped serrations in a zigzag pattern, even when the conductor of the aluminum electrical cable plays in the conductor caulking pieces of the terminal due to a thermal shock test, the core wires of the conductor are not scarred by corners of the serrations, thereby sufficiently exhibiting the strain relief effect.

DESCRIPTION OF EMBODIMENTS

Specific embodiments of a crimping structure of a terminal to an electrical cable according to the present invention will be now described in detail with reference to the accompanying drawings.

First Embodiment

Figure 1:
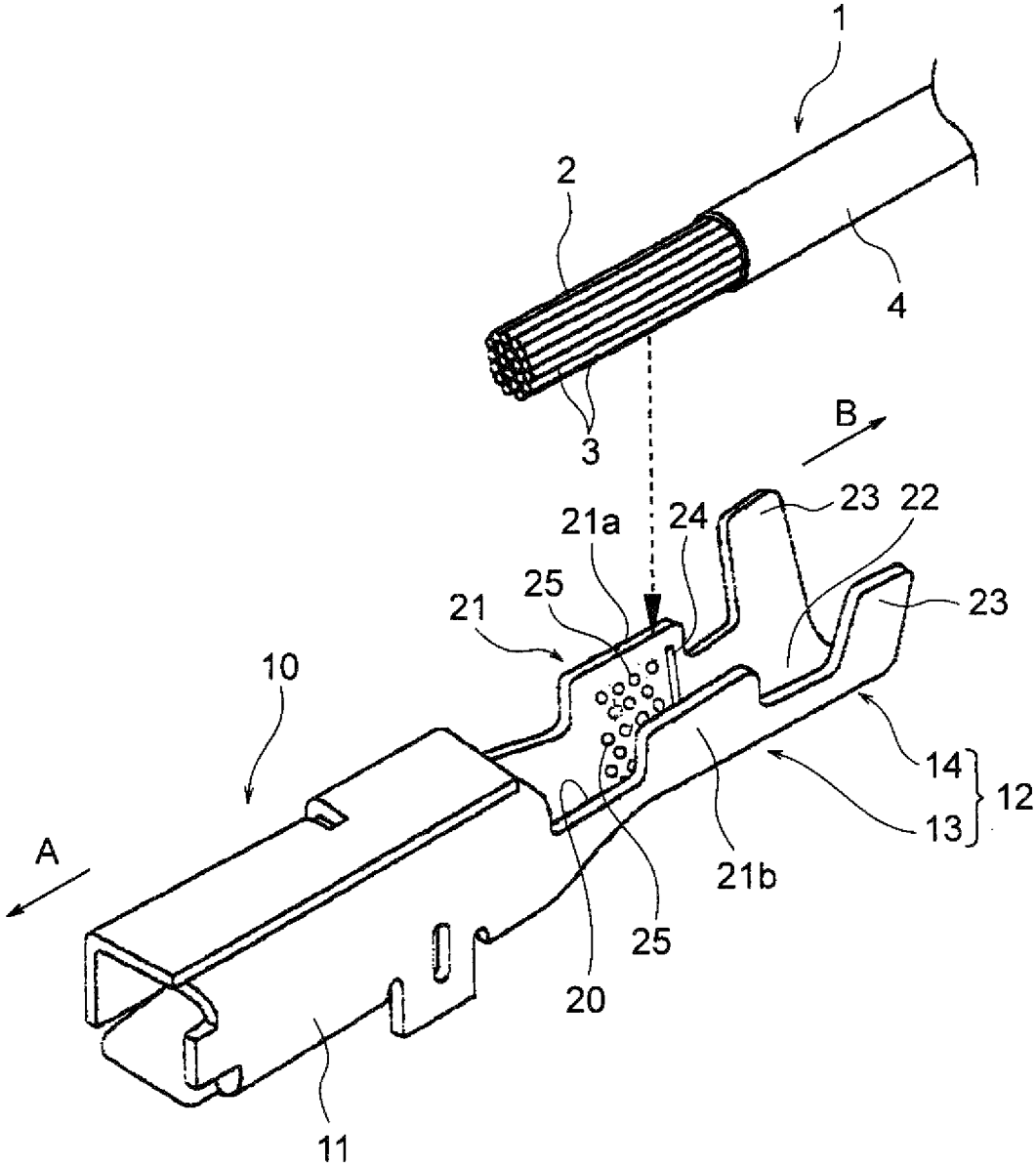
FIG. 1 is a perspective view showing a first embodiment of a crimping structure of a terminal to an electrical cable according to the present invention.
Figure 2:
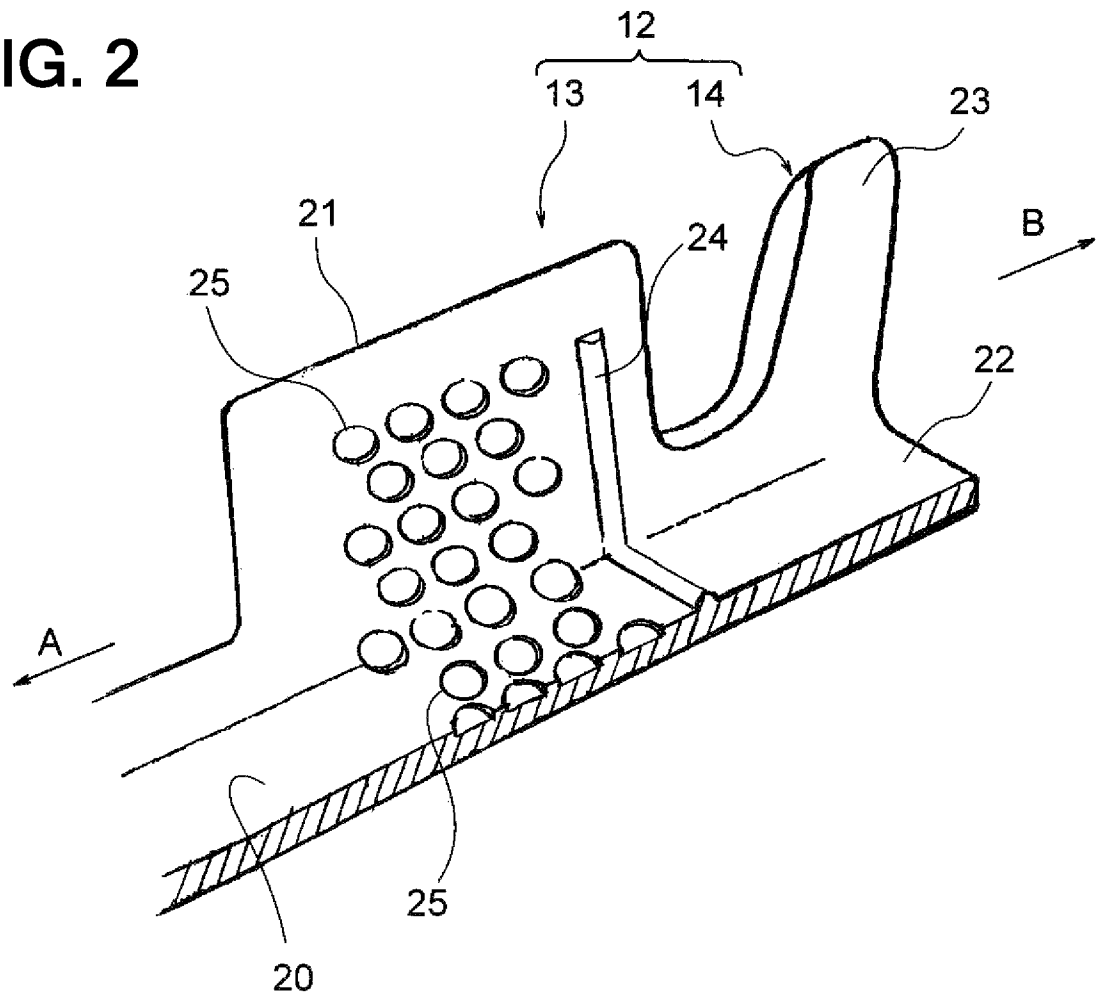
FIG. 2 is a perspective view showing a main part of FIG. 1 vertically broken along a longitudinal direction thereof to pass through the center in a transverse direction.
Figure 3:
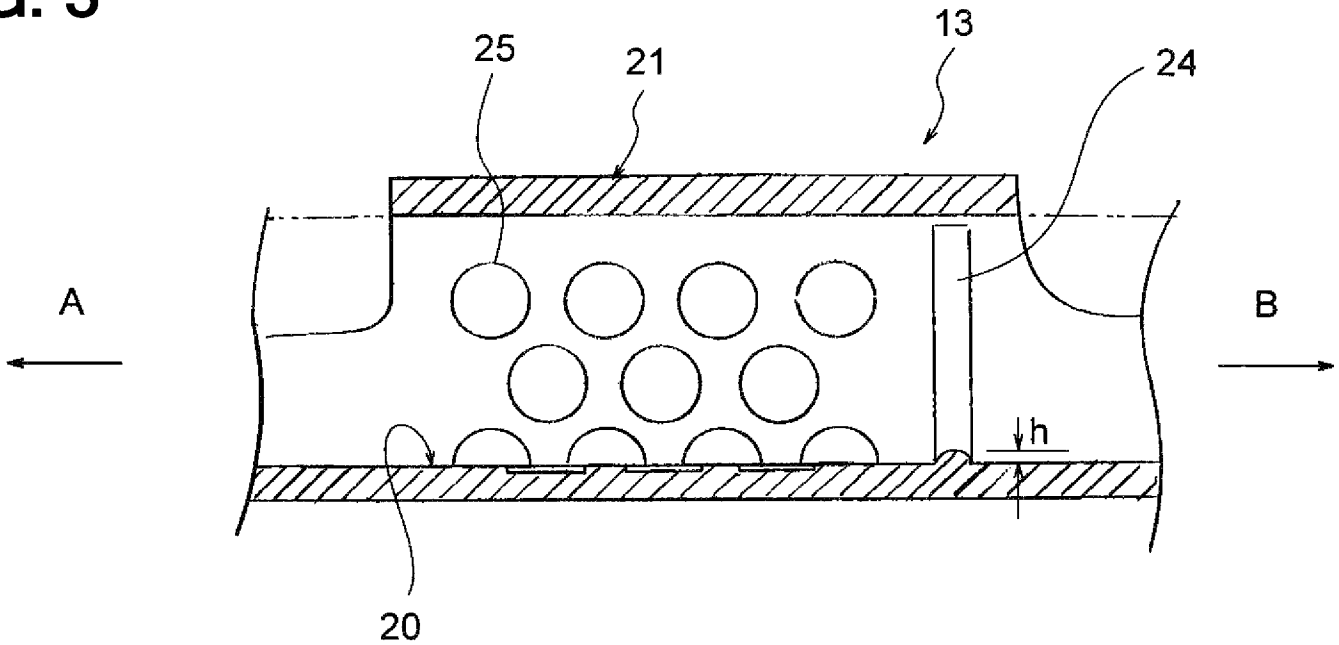
FIG. 3 is a front view of the terminal shown in FIG. 2.

FIGS. 1 to 3 are views showing a first embodiment of a crimping structure of a terminal to an electrical cable according to the present invention.

FIG. 1 is a whole perspective view showing the first embodiment of a crimping structure of a terminal to an electrical cable according to the present invention, FIG. 2 is a partially enlarged sectional perspective view showing a main part of FIG. 1 vertically broken along a longitudinal direction thereof to pass through the center in a transverse direction, and FIG. 3 is a view showing when the partially enlarged sectional perspective view of the terminal shown in FIG. 2 is viewed from the front.

Meanwhile, in the drawings, an arrow A indicates a distal end (front end) direction of the terminal and an arrow B indicates a proximal end (rear end) direction of the terminal.

In FIG. 1, a reference numeral 1 designates an aluminum electrical cable. This aluminum electrical cable 1 is constituted as a covered electrical cable, in which a conductor 2 is formed by twisting a plurality of aluminum or aluminum alloy wires 3 together and an outer circumference of the conductor 2 is covered with a sheath 4 formed of an insulating material.

The aluminum alloy constituting the aluminum electrical cable 1 includes, for example, an alloy of aluminum and iron. This alloy can be easily elongated, as compared to a conductor made of aluminum, thereby increasing a strength (particularly, a tensile strength).

In addition, at an end portion of the aluminum electrical cable 1 (i.e., a distal end of the electrical cable), the conductor 2 is exposed by removing the sheath 4 by a predetermined length, and a terminal 10 is crimped on the end portion of the aluminum electrical cable 1.

As shown in FIG. 1, the terminal 10 is formed by press-forming (including bending) a plate material made of a conductive metal, such as a copper alloy. A distal end of the terminal 10 is provided with a connection portion 11 to a corresponding terminal (not shown), and a proximal end thereof is provided with a holding portion 12 for holding the aluminum electrical cable 1.

The holding portion 12 is provided on a distal end side thereof with a conductor holding part 13 for holding an exposed distal end of the conductor 2 of the aluminum electrical cable 1 and is provided on a proximal end side thereof with a sheath holding part 14 for holding the sheath 4 of the aluminum electrical cable 1.

The conductor holding part 13 has a bottom plate 20 and conductor caulking pieces 21, and thus is formed in a generally U shape in a cross section perpendicular to a longitudinal direction of the terminal 10.

The bottom plate 20 is intended to allow the conductor 2 exposed at the end portion of the aluminum electrical cable 1 to be placed thereon.

In addition, the conductor caulking pieces 21 are provided to be continuous to the bottom plate 20 and to be in a pair and are configured to allow the conductor 2 exposed at the end portion of the aluminum electrical cable 1 and placed on the bottom plate 20 to be sandwiched therebetween.

The sheath holding part 14 has a bottom plate 22 adapted to allow the sheath 4 on the end portion of the aluminum electrical cable 1 to be placed thereon, and a pair of sheath caulking pieces 23 provided to be continuous to the bottom plate 22 and thus to allow the sheath 4 placed on the bottom plate 22 to be sandwiched therebetween.

In addition, similarly to the conductor holding part 13, the sheath holding part 14 is formed in a generally U-shape.

The bottom plate 22 of the sheath holding part 14 is provided to be continuous to a proximal end of the bottom plate 20 of the conductor holding part 13.

As shown in FIGS. 2 and 3, an indent 24 is provided on the bottom plate 20 and the pair of conductor caulking pieces 21 of the terminal 10 to be extended from one conductor caulking piece 21*a* of the pair of conductor caulking pieces 21 through the bottom plate 20 to the other conductor caulking piece 21*b*. The indent 24 is provided on sides of the pair of conductor caulking pieces 21 which are located toward the sheath caulking pieces 23, and, as shown in FIG. 2, is also provided to be perpendicular to an axis direction of a crimped portion of the conductor 2 of the aluminum electrical cable 1.

Also, the indent 24 is formed in a semi-cylindrical shape. In this way, by forming the indent 24 in the semi-cylindrical shape, the indent 24 has a strain relief effect without scarring the conductor 2 of the aluminum electrical cable 1, when the conductor 2 exposed at the end portion of the aluminum electrical cable 1 is caulked by the bottom plate 20 and the pair of conductor caulking pieces 21, thereby enhancing a fixing strength to the conductor 2 of the aluminum electrical cable 1.

Because the terminal 10 is provided with the indent 24, when the conductor 2 exposed at the end portion of the aluminum electrical cable 1 is caulked by the terminal 1, this seems that the terminal 10 grasps the conductor 2 of the aluminum electrical cable 1. Therefore, if the aluminum electrical cable 1 is pulled, the indent 24 prevents the conductor 2 of the aluminum electrical cable 1 from being directly pulled. In other words, by providing the indent 24, when the aluminum electrical cable 1 is pulled, the pulling force is originally exerted on the indent 24 grasping the conductor 2 of the aluminum electrical cable 1 thereby preventing a stress from being directly applied to the conductor 2 of the aluminum electrical cable 1.

Figure 4:
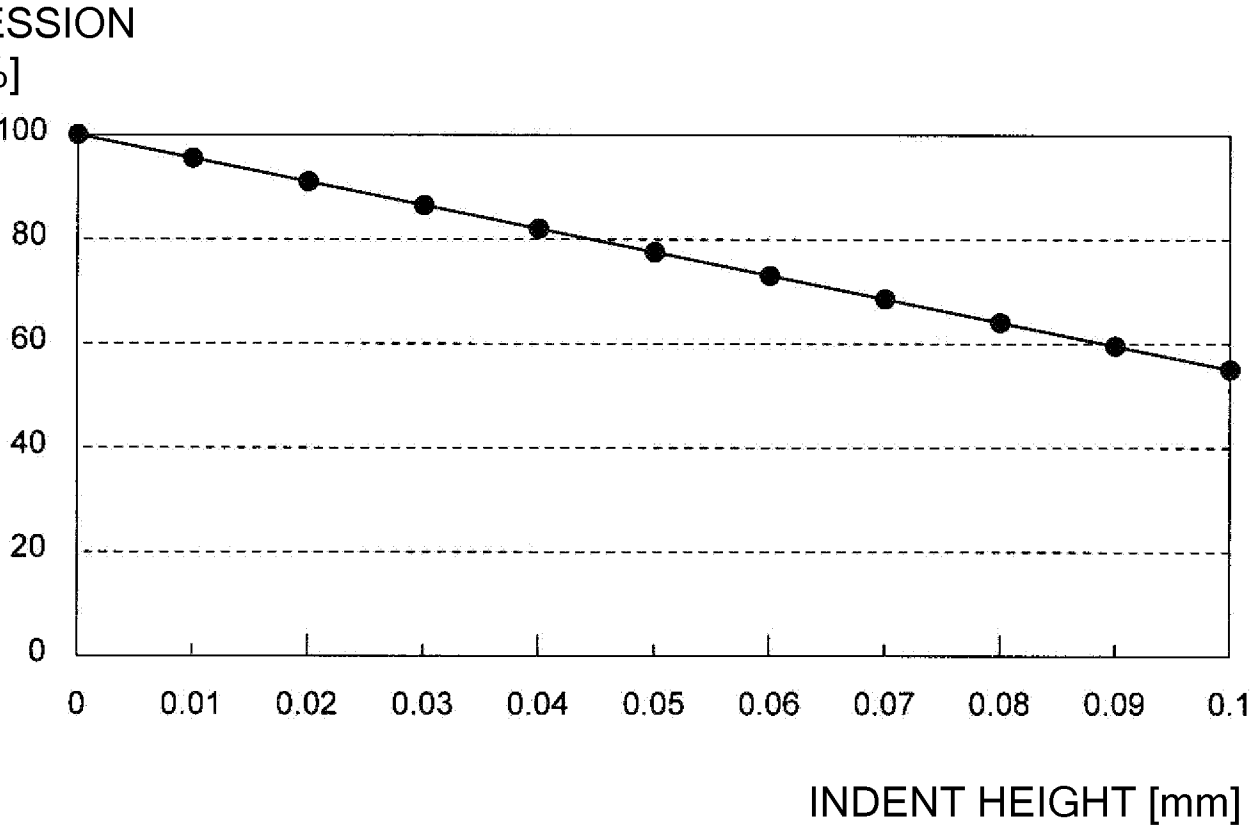
FIG. 4 is a characteristic view showing a relation of a compression ratio of a conductor of an aluminum electrical cable to a height of an indent.

In FIG. 4, a relation between a height h of the indent 24 (i.e., a distance from a surface of the bottom plate 20 to a peak of the indent 24) and a compression ratio of the conductor 2 when the pair of conductor caulking pieces 21 of the terminal 10 are strongly caulked on the conductor 2 is illustrated.

FIG. 4 illustrates how the compression ratio of the conductor 2 is changed according to the height h of the indent 24, in which the vertical axis shows the compression ratio of the conductor 2 of the aluminum electrical cable 1 and the horizontal axis shows the height h of the indent 24 in 0.01 mm increments, thereby illustrating a change of the compression ratio according to the height h of the indent 24.

From FIG. 4, when the height h of the indent 24 is 0.01 mm or more and less than 0.03 mm, the conductor 2 of the aluminum electrical cable 1 has a high compression ratio of 90% or more, thereby inhibiting a decrease in the compression ratio. In addition, when the height h of the indent 24 is 0.01 mm or more and less than 0.03 mm, an oxide film on each of wires 3 constituting the conductor 2 of the aluminum electrical cable 1 is broken, thereby achieving a reduction of a contact resistance between the conductor 2 and the terminal 10.

However, in the height h of the indent 24 of 0.01 mm or more and less than 0.03 mm, a strain relief effect of inhibiting a slip of the conductor 2 of the aluminum electrical cable 1 by the indent 24 to prevent a force from being directly exerted on the conductor 2 of the aluminum electrical cable 1 when the aluminum electrical cable 1 is pulled by a certain cause cannot be achieved.

Also, when the height h of the indent 24 is 0.03 mm or more, the indent 24 inhibits a slip of the conductor 2 of the aluminum electrical cable 1, and thus the strain relief effect of preventing a force from being directly exerted on the conductor 2 of the aluminum electrical cable 1 when the aluminum electrical cable 1 is pulled by a certain cause is occurred by the indent 24.

If the height h of the indent 24 is 0.03 mm or more, the compression ratio of the conductor 2 of the aluminum electrical cable 1 starts to gradually decrease from 90%. Namely, the compression ratio of the conductor 2 of the aluminum electrical cable 1 is decreased.

In the aluminum electrical cable 1, a contact resistance between the conductor 2 and the terminal 10 tends to be relatively high. Therefore, to reduce the contact resistance, a method is employed, in which a pair of conductor caulking pieces 21 of the terminal 10 are strongly caulked on the conductor 2 so that the compression ratio of the conductor 2 is increased.

Accordingly, if the height h of the indent 24 becomes 0.03 mm or more and thus the compression ratio of the conductor 2 of the aluminum electrical cable 1 starts to gradually decrease from 90%, as a result of which the compression ratio of the conductor 2 of the aluminum electrical cable 1 is decreased, the contact resistance between the conductor 2 and the terminal 10 is increased, thereby decreasing an effect of reducing the contact resistance between the conductor 2 and the terminal 10 by breaking the oxide film on each of wires 3 constituting the conductor 2.

It can be found that the effect of reducing the contact resistance between the conductor 2 and the terminal 10 by breaking the oxide film on each of wires 3 constituting the conductor 2 can cause an obstacle because an intended contact resistance cannot be obtained if the compression ratio of the conductor 2 of the aluminum electrical cable 1 does not exceed 60% even when decreasing from 100%.

If the height h of the indent 24 becomes 0.03 mm or more, the strain relief effect of inhibiting a slip of the conductor 2 of the aluminum electrical cable 1 by the indent 24 to prevent a force from being directly exerted on the conductor 2 of the aluminum electrical cable 1 when the aluminum electrical cable 1 is pulled by a certain cause is gradually enhanced.

However, as the compression ratio of the conductor 2 of the aluminum electrical cable 1 is decreased, the contact resistance between the conductor 2 and the terminal 10 is increased, and as a result, the effect of reducing the contact resistance between the conductor 2 and the terminal 10 by breaking the oxide film on each of wires 3 constituting the conductor 2 is decreased.

Accordingly, from FIG. 4, it can be found that the height h of the indent 24 is 0.08 mm or less so that the compression ratio is not below 60% to allow the intended contact resistance to be obtained. In other words, by setting the height h of the indent 24 to a range of 0.03 mm to 0.08 mm, the effect of reducing the contact resistance between the conductor 2 and the terminal 10 by breaking the oxide film on each of wires 3 constituting the conductor 2 can be obtained, and also the strain relief effect of inhibiting a slip of the conductor 2 of the aluminum electrical cable 1 to prevent a force from being directly exerted on the conductor 2 of the aluminum electrical cable 1 when the aluminum electrical cable 1 is pulled by a certain cause can be obtained.

As shown in FIGS. 2 and 3, serrations (recesses) 25 formed in a circular shape are arranged on a portion of upper surfaces (inner surfaces) of the bottom plate 20 and the pair of conductor caulking pieces 21 of the terminal 10, which is located toward the distal end of the aluminum electrical cable 1 from a location where the indent 24 is formed.

Because the serrations 25 are formed in the circular shape as described above, when the aluminum electrical cable 1 is pulled by a certain cause so that a force is directly exerted on the conductor 2 of the aluminum electrical cable 1, it is possible to prevent core wires of the conductor 2, which is formed by twisting a plurality of aluminum or aluminum alloy wires 3 together and is caulked by the conductor caulking pieces 21, from being subject to damage, such as scars, by corners of the serrations, thereby preventing a decrease in the fixing strength.

Also, the serrations 25 are provided in a region from one conductor caulking piece 21*a* of the pair of conductor caulking pieces 21 through the bottom plate 20 to the other conductor caulking piece 21*b*. In addition, as shown in FIGS. 2 and 3, the serrations 25 are arranged in a zigzag pattern.

In this way, by arranging the serrations 25, which is formed in the circular shape, in the zigzag pattern, even if core wires of the conductor 2 formed by twisting a plurality of aluminum or aluminum alloy wires 3 together are excessively compressed, the core wires of the conductor 2 are not scarred by corners of the serrations 25 even when the aluminum electrical cable 1 is pulled by a certain cause so that a force is directly exerted on the conductor 2 of the aluminum electrical cable 1, thereby sufficiently and more effectively exhibiting the strain relief effect.

Figure 5:
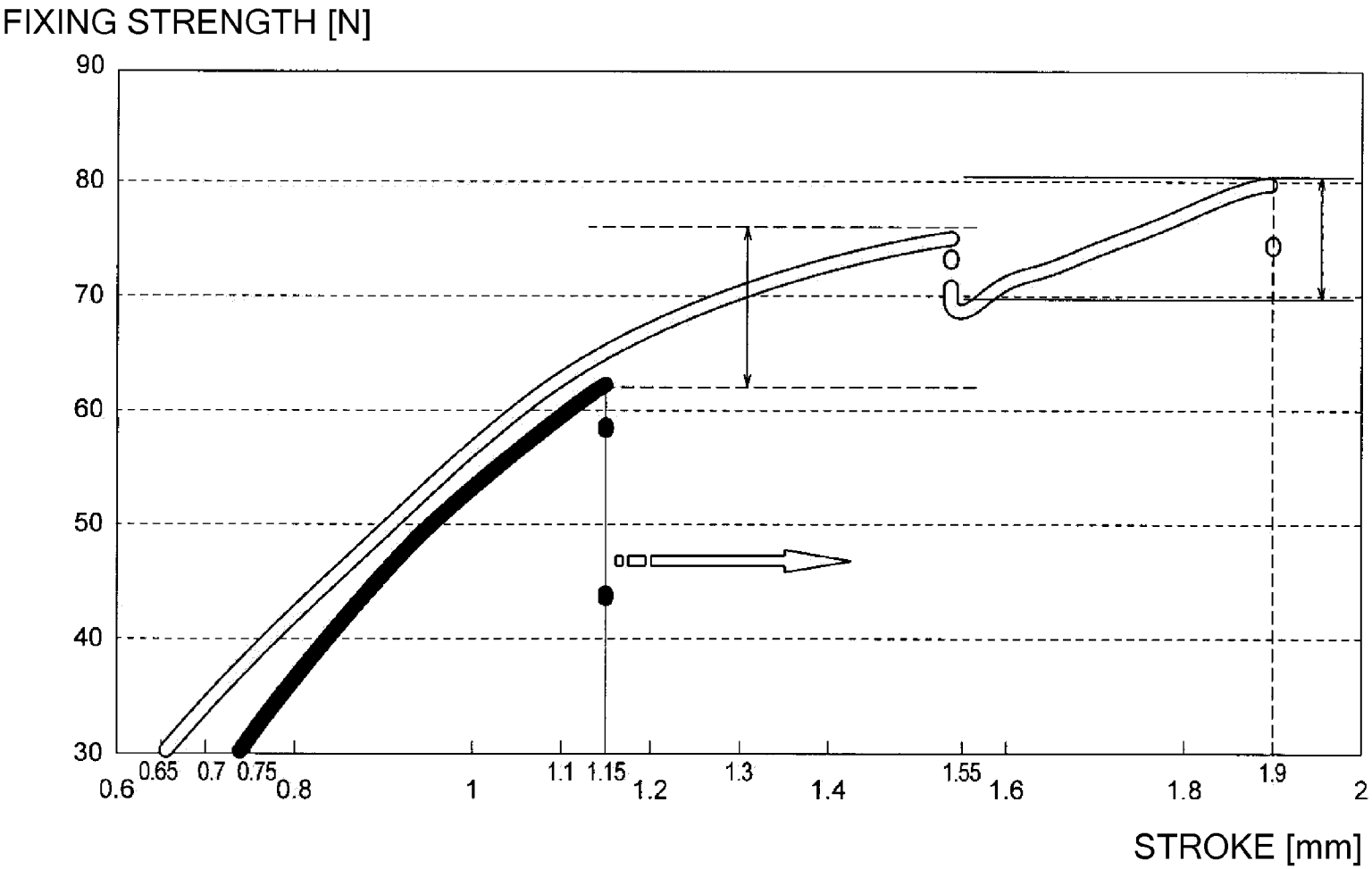
FIG. 5 is a view showing a comparison between a conductor of an aluminum electrical cable, to which a conventional terminal is attached, and a conductor of an aluminum electrical cable, to which the terminal of the first embodiment shown in FIG. 1 is attached, with respect to characteristics of fixing strengths when the electrical cables are pulled until the conductors of the electrical cables are elongated and broken.

FIG. 5 shows characteristic test results of each of the crimping structure of a terminal to an electrical cable according to the first embodiment as described above and a conventional crimping structure of a terminal to an electrical cable when a tensile load is increased until the conductor 2 of the aluminum electrical cable 1 is broken.

In the test according to FIG. 5, a structure, in which the terminal according to the first embodiment is attached to a conductor of an electrical cable formed by twisting three aluminum wires of 0.13 $mm^2$ together and then the conductor is compressed at a compression ratio of 70% by conductor caulking pieces of the terminal, and a structure, in which a conventional terminal is attached to a conductor of an electrical cable formed by twisting three aluminum wires of 0.13 $mm^2$ together and then the conductor is compressed at a compression ratio of 70% by conductor caulking pieces of the terminal, are used to measure fixing strengths according to a stroke length (elongation length) of the conductors of the aluminum electrical cables when the aluminum wires are pulled until the conductors of the electrical cables are broken.

Namely, FIG. 5 shown how conductors 2 of aluminum electrical cables 1 are elongated until being broken, when tensile loads are exerted on a structure, in which the conductor 2 of the aluminum electrical cable 1 is placed on the bottom plate 20 of the terminal 10 according to the first embodiment and then caulked by the pair of conductor caulking pieces 21 so that the terminal 10 is attached to the aluminum electrical cable 1, and a structure, in which the conductor 2 of the aluminum electrical cable 1 is placed on a bottom plate of a conventional terminal and then caulked by a pair of conductor caulking pieces so that the conventional terminal is attached to the aluminum electrical cable 1.

FIG. 5 is a characteristic view showing a relation between elongation lengths of the conductors 2 of the aluminum electrical cables 1 and tensile loads when the aluminum electrical cables 1 are pulled until the conductors 2 of the aluminum electrical cables 1 are elongated and broken.

In other words, FIG. 5 shown a change of the tensile loads when the aluminum electrical cables 1 are pulled while increasing the tensile load until the conductors 2 of the aluminum electrical cables 1 are elongated and broken.

In this way, the tensile loads exerted on the aluminum electrical cables 1 when the aluminum electrical cables 1 are pulled until the conductors 2 of the aluminum electrical cables 1 are elongated and broken are measured. Therefore, the tensile loads exerted on the aluminum electrical cables 1 are indicated as fixing strengths (N) of the conductors 2 of the aluminum electrical cables 1 to the terminal 10 until the conductors 2 of the aluminum electrical cables 1 placed on the bottom plate 20 of the terminal 10 and caulked by a pair of conductor caulking pieces 21 are elongated and broken.

Accordingly, in FIG. 5, a horizontal axis shows elongation lengths (strokes) of the conductors 2 of the aluminum electrical cables 1 and a vertical axis shows a change of fixing strengths (N) of the conductors 2 of the aluminum electrical cables 1 to the terminal 10, thereby describing a change thereof.

In FIG. 5, a case A relates to the first embodiment in which the conductor 2 of the aluminum electrical cable 1 is placed on the bottom plate 20 of the terminal 10 according to the first embodiment so that the terminal 10 is attached to the conductor 2 of the aluminum electrical cable 1, and a case B relates to a conventional example in which the conductor 2 of the aluminum electrical cable 1 is placed on a bottom plate of a conventional terminal and then caulked by a pair of conductor caulking pieces so that the conventional terminal is attached to the aluminum electrical cable 1

From FIG. 5, the case B according to the conventional example shows that the fixing strength when the aluminum electrical cable 1 is pulled so that the stroke (elongation length) of the conductor 2 of the aluminum electrical cable 1 is 0.75 mm is 30 N.

Contrarily, the case A according to the first embodiment shows that the stroke (elongation length) of the conductor 2 of the aluminum electrical cable 1 is 0.65 mm when the fixing strength is the same 30 N.

This means that the strokes (elongation lengths) of the conductors 2 of the aluminum electrical cables 1 in the case A of the first embodiment and the case B of the conventional example are different from each other when the same tensile loads are exerted on the aluminum electrical cables 1, and thus that a case, in which the stroke (elongation length) of the conductor 2 of the aluminum electrical cable 1 is smaller when the same tensile loads are exerted on the aluminum electrical cables 1, has a better characteristic.

As can be apparently seen from FIG. 5, it can be found that the strokes (elongation lengths) of the conductors 2 of the aluminum electrical cables 1 in the case B of the conventional example and the case A of the first embodiment are increased as the tensile loads are further increased. In addition, as can be also apparently seen from FIG. 5, when the tensile load exerted on the aluminum electrical cable 1 exceeds 60 N, the case B of the conventional example shows that the stroke (elongation length) of the conductor 2 of the aluminum electrical cable 1 is extended up to 1.15 mm at 63 N, and, when the tensile load of 63 N is exerted thereon, the conductor 2 of the aluminum electrical cable 1 is broken.

Namely, when the tensile load exerted on the aluminum electrical cable 1 is increased, the case B of the conventional example shows that the stroke (elongation length) of the conductor 2 of the aluminum electrical cable 1 is extended up to 1.15 mm, and, when the tensile load of 63 N is exerted thereon, the conductor 2 of the aluminum electrical cable 1 is broken.

As a result, it can be found from FIG. 5 that the fixing strength of the case B according to the conventional example is 63 N.

Meanwhile, in the case A of the first embodiment, it can be found that the stroke (elongation length) of the conductor 2 of the aluminum electrical cable 1 is extended up to 1.55 mm, and the fixing strength at this time is 74 N.

Also, when the tensile load exerted on the aluminum electrical cable 1 is increased so that the tensile load of 80N is exerted thereon, the case A of the first embodiment shows that the stroke (elongation length) of the conductor 2 of the aluminum electrical cable 1 is extended up to 1.9 mm, and, when the tensile load of 80 N is exerted thereon, the conductor 2 of the aluminum electrical cable 1 is broken.

Namely, it can be found from FIG. 5 that, in the case A of the first embodiment, the fixing strength when the aluminum electrical cable 1 is pulled so that the stroke (elongation length) of the conductor 2 of the aluminum electrical cable 1 is 1.9 mm is 80 N.

In FIG. 5, it can be found that the case A of the first embodiment has an enhanced characteristic relative to the case B of the conventional example from a point where the fixing strength of the case B of the conventional example is 63 N, indicating that the aluminum electrical cable 1 according to the case B of the conventional example is broken, to a point where the stroke (elongation length) of the conductor 2 of the aluminum electrical cable 1 is extended up to 1.55 mm and the fixing strength at this time is 74 N.

Such a region from a point, where the fixing strength is 63 N, to a point, where the fixing strength is 74 N, is obtained by the strain relief effect due to the indent 24.

In FIG. 5, it can be found that the case A of the first embodiment has a further enhanced characteristic from a point where the stroke (elongation length) of the conductor 2 of the aluminum electrical cable 1 is extended up to 1.55 mm and the fixing strength at this time is 74 N, to a point where the stroke (elongation length) of the conductor 2 of the aluminum electrical cable 1 is extended up to 1.9 mm by further increasing the tensile load exerted on the aluminum electrical cable 1 and the fixing strength at this time is 80 N.

In the case A of the first embodiment, such a region from a point, where the fixing strength is 69 N, to a point, where the fixing strength is 80 N, is obtained by a dispersion effect due to the serrations 25.

Namely, the case A of the first embodiment has an enhanced fixing strength characteristic from a point, where the stroke (elongation length) of the conductor 2 of the aluminum electrical cable 1 is extended up to 1.3 mm and thus the fixing strength exceeds 74 N, by a combination of the strain relief effect due to the indent 24 and the dispersion effect due to the serrations 25.

In this way, as compared to the case B of the conventional example, according to the case A of the first embodiment, the stroke (elongation length) of the conductor 2 of the aluminum electrical cable 1 can be elongated 0.75 mm longer than the case B of the conventional example (i.e., the stroke to failure can be increased) and the fixing strength can be increased 17 N greater than the case B of the conventional example. Accordingly, the case A of the first embodiment can have an enhanced characteristic, as compared to the case B of the conventional example.

Second Embodiment

Figure 6:
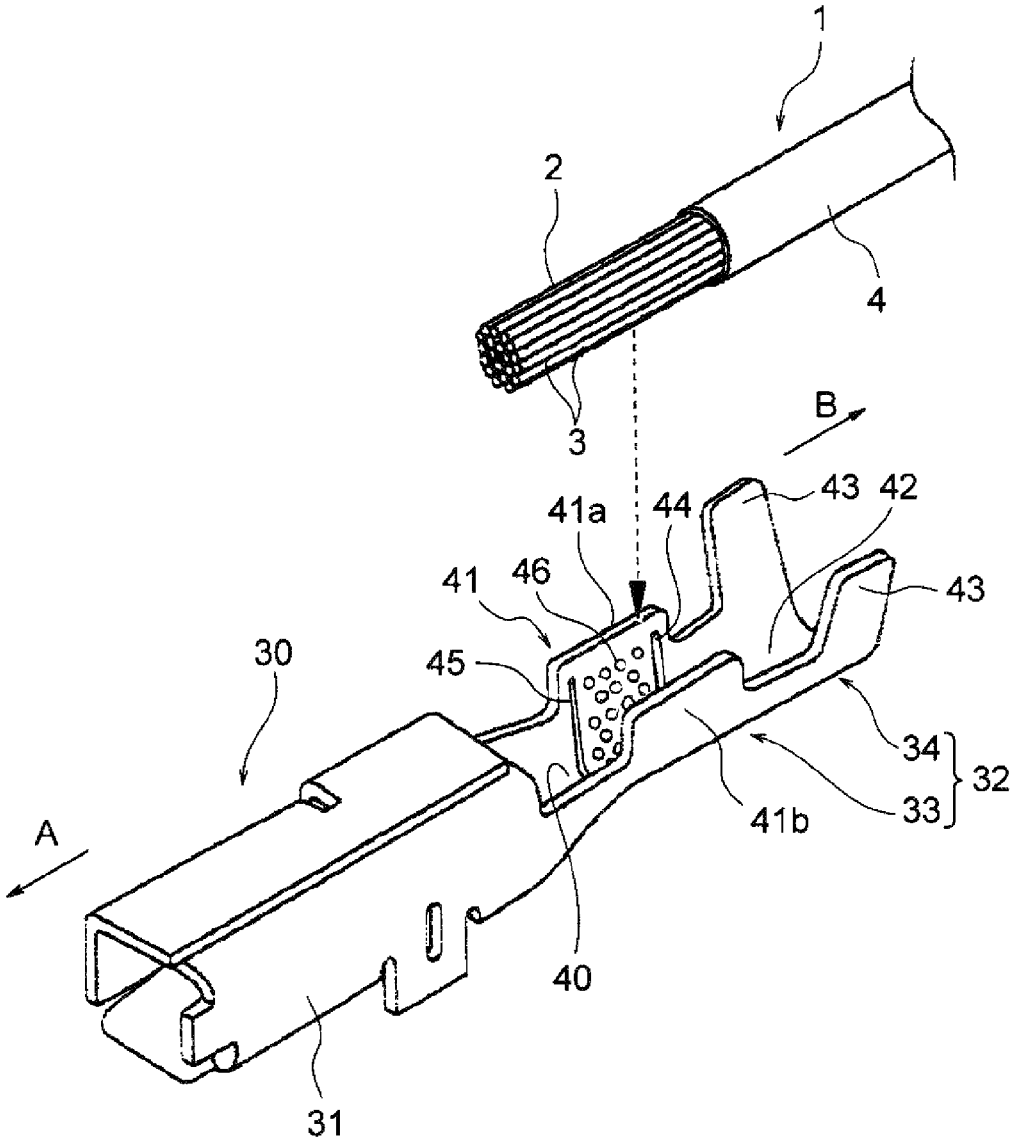
FIG. 6 is a perspective view showing a second embodiment of a crimping structure of a terminal to an electrical cable according to the present invention.
Figure 7:
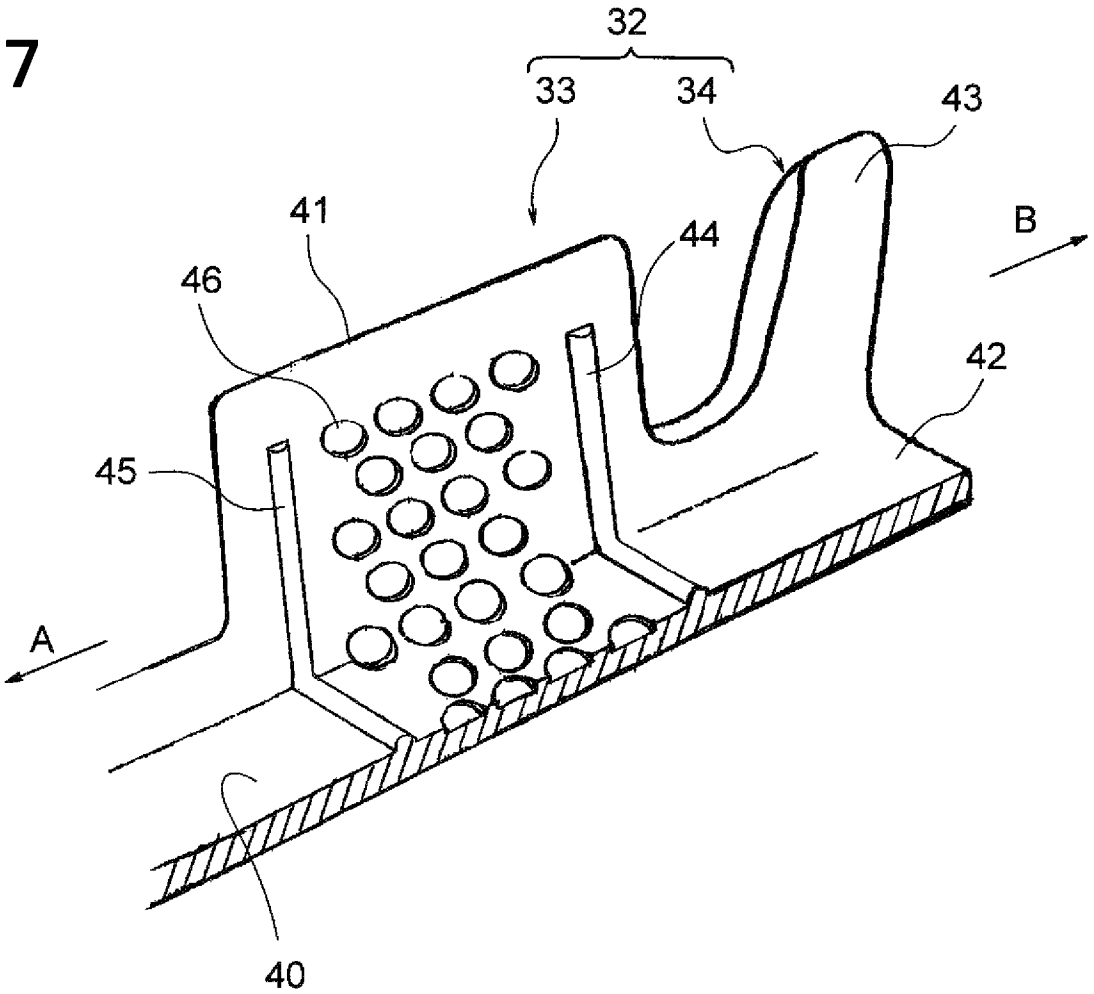
FIG. 7 is a perspective view showing a main part of FIG. 6 vertically broken along a longitudinal direction thereof to pass through the center in a transverse direction.
Figure 8:
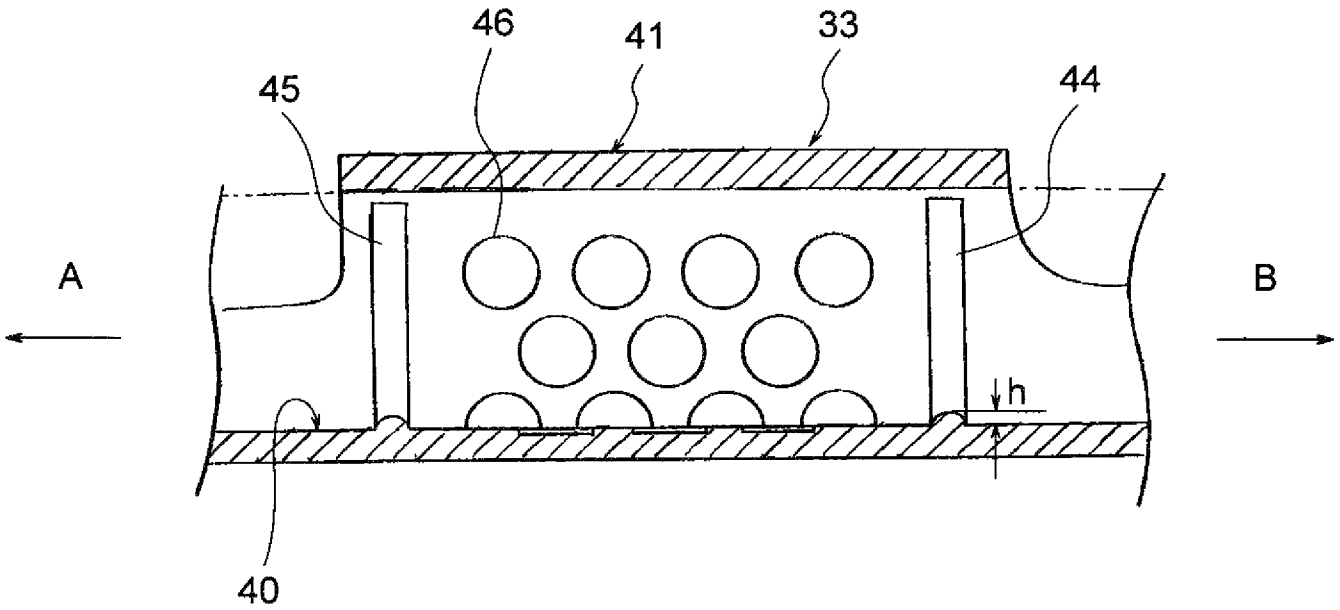
FIG. 8 is a front view of the terminal shown in FIG. 7.

FIGS. 6 to 8 are views showing a second embodiment of a crimping structure of a terminal to an electrical cable according to the present invention.

FIG. 6 is a whole perspective view showing the second embodiment of a crimping structure of a terminal to an electrical cable according to the present invention, FIG. 7 is a partially enlarged sectional perspective view showing a main part of FIG. 6 vertically broken along a longitudinal direction thereof to pass through the center in a transverse direction, and FIG. 8 is a view showing when the partially enlarged sectional perspective view of the terminal shown in FIG. 7 is viewed from the front.

Meanwhile, in the drawings, an arrow A indicates a distal end (front end) direction of the terminal and an arrow B indicates a proximal end (rear end) direction of the terminal.

The second embodiment is different from the first embodiment shown in FIGS. 1 to 3 in that a second indent 45 is further provided in addition to an indent 44 so that serrations 45 are disposed therebetween. The second indent 45 is formed in a semi-cylindrical shape on distal end sides of a pair of conductor caulking pieces 41 and is extended from one conductor caulking piece 41*a* through a bottom plate 40 to the other conductor caulking piece 41*b* to be perpendicular to an axis direction of a crimped portion of a conductor 2 of an aluminum electrical cable 1.

Except for the foregoing, the second embodiment is not different from the first embodiment shown in FIGS. 1 to 3.

In FIG. 6, a reference numeral 1 designates an aluminum electrical cable. This aluminum electrical cable 1 is constituted as a covered electrical cable, in which a conductor 2 is formed by twisting a plurality of aluminum or aluminum alloy wires 3 together and an outer circumference of the conductor 2 is covered with a sheath 4 formed of an insulating material.

The aluminum alloy constituting the aluminum electrical cable 1 includes, for example, an alloy of aluminum and iron. This alloy can be easily elongated, as compared to a conductor made of aluminum, thereby increasing a strength (particularly, a tensile strength).

In addition, at an end portion of the aluminum electrical cable 1 (i.e., a distal end of the electrical cable), the conductor 2 is exposed by removing the sheath 4 by a predetermined length, and a terminal 30 is crimped on the end portion of the aluminum electrical cable 1.

As shown in FIG. 6, the terminal 30 is formed by press-forming (including bending) a plate material made of a conductive metal, such as copper alloy. A distal end of the terminal 30 is provided with a connection portion 31 to a corresponding terminal (not shown), and a proximal end thereof is provided with a holding portion 32 for holding the aluminum electrical cable 1.

The holding portion 32 is provided on a distal end side thereof with a conductor holding part 33 for holding an exposed distal end of the conductor 2 of the aluminum electrical cable 1 and is provided on a proximal end side thereof with a sheath holding part 44 for holding the sheath 4 of the aluminum electrical cable 1.

The conductor holding part 33 has a bottom plate 40 and conductor caulking pieces 41, and thus is formed in a generally U shape in a cross section perpendicular to a longitudinal direction of the terminal 30.

The bottom plate 40 is intended to allow the conductor 2 exposed at the end portion of the aluminum electrical cable 1 to be placed thereon.

In addition, the conductor caulking pieces 41 are provided to be continuous to the bottom plate 40 and to be in a pair and are configured to allow the conductor 2 exposed at the end portion of the aluminum electrical cable 1 and placed on the bottom plate 40 to be sandwiched therebetween.

The sheath holding part 44 has a bottom plate 42 adapted to allow the sheath 4 on the end portion of the aluminum electrical cable 1 to be placed thereon, and a pair of sheath caulking pieces 43 provided to be continuous to the bottom plate 42 and thus to allow the sheath 4 placed on the bottom plate 42 to be sandwiched therebetween.

In addition, similarly to the conductor holding part 33, the sheath holding part 34 is formed in a generally U-shape.

The bottom plate 42 of the sheath holding part 34 is provided to be continuous to a proximal end of the bottom plate 40 of the conductor holding part 33.

As shown in FIGS. 7 and 8, a first indent 44 is provided on the bottom plate 40 and the pair of conductor caulking pieces 41 of the terminal 30 to be extended from one conductor caulking piece 41*a* of the pair of conductor caulking pieces 41 through the bottom plate 40 to the other conductor caulking piece 41*b*. The first indent 44 is provided on sides of the pair of conductor caulking pieces 41 which are located toward the sheath caulking pieces 43, and, as shown in FIG. 7, is also provided to be perpendicular to an axis direction of a crimped portion of the conductor 2 of the aluminum electrical cable 1.

Also, the first indent 44 is formed in a semi-cylindrical shape. In this way, by forming the first indent 44 in the semi-cylindrical shape, the first indent 44 has a strain relief effect without scarring the conductor 2 of the aluminum electrical cable 1, when the conductor 2 exposed at the end portion of the aluminum electrical cable 1 is caulked by the bottom plate 40 and the pair of conductor caulking pieces 41, thereby enhancing a fixing strength to the conductor 2 of the aluminum electrical cable 1.

Because the terminal 30 is provided with the first indent 44, when the conductor 2 exposed at the end portion of the aluminum electrical cable 1 is caulked, this seems that the terminal 30 grasps the conductor 2 of the aluminum electrical cable 1. Therefore, if the aluminum electrical cable 1 is pulled, the first indent 44 prevents the conductor 2 of the aluminum electrical cable 1 from being directly pulled. In other words, by providing the first indent 44, when the aluminum electrical cable 1 is pulled, the pulling force is originally exerted on the first indent 44 grasping the conductor 2 of the aluminum electrical cable 1 thereby preventing a stress from being directly applied to the conductor 2 of the aluminum electrical cable 1.

As shown in FIGS. 7 and 8, a second indent 45 is provided on the bottom plate 40 and the pair of conductor caulking pieces 41 of the terminal 30 to be extended from one conductor caulking piece 41*a* of the pair of conductor caulking pieces 41 through the bottom plate 40 to the other conductor caulking piece 41*b*. The second indent 45 is provided on sides of the pair of conductor caulking pieces 41 which are located toward the distal end of the electrical cable, and, as shown in FIG. 7, is also provided to be perpendicular to an axis direction of a crimped portion of the conductor 2 of the aluminum electrical cable 1.

Similarly to the first indent 44, the second indent 45 is also formed in a semi-cylindrical shape. In this way, by forming the second indent 45 in the semi-cylindrical shape, the first indent 44 and the second indent 45 have a strain relief effect without scarring the conductor 2 of the aluminum electrical cable 1, when the conductor 2 exposed at the end portion of the aluminum electrical cable 1 is caulked by the bottom plate 40 and the pair of conductor caulking pieces 41, thereby enhancing a fixing strength to the conductor 2 of the aluminum electrical cable 1.

Because the terminal 30 is provided with the first indent 44 and the second indent 45, when the conductor 2 exposed at the end portion of the aluminum electrical cable 1 is caulked, this seems that the terminal 30 grasps the conductor 2 of the aluminum electrical cable 1. Therefore, if the aluminum electrical cable 1 is pulled, the first indent 44 and the second indent 45 prevents the conductor 2 of the aluminum electrical cable 1 from being directly pulled.

In other words, by providing the first indent 44 and the second indent 45, when the aluminum electrical cable 1 is pulled, the pulling force is originally exerted on the first indent 44 and the second indent 45 grasping the conductor 2 of the aluminum electrical cable 1, thereby preventing a stress from being directly applied to the conductor 2 of the aluminum electrical cable 1.

In this way, by providing the second indent 45 in addition to the first indent 44, the strain relief effect can be further enhanced relative to a case where the first indent 44 is only provided.

As shown in FIGS. 7 and 8, serrations (recesses) 46 formed in a circular shape are arranged on a portion of upper surfaces (inner surfaces) of the bottom plate 30 and the pair of conductor caulking pieces 41 of the terminal 30, which is located between the first indent 44 and the second indent 45.

Because the serrations 46 are formed in the circular shape as described above, when the aluminum electrical cable 1 is pulled by a certain cause so that a force is directly exerted on the conductor 2 of the aluminum electrical cable 1, it is possible to prevent core wires of the conductor 2, which is formed by twisting a plurality of aluminum or aluminum alloy wires 3 together and is caulked by the conductor caulking pieces 41, from being subject to damage, such as scars, by corners of the serrations, thereby preventing a decrease in the fixing strength.

Also, the serrations 46 are provided in a region from one conductor caulking piece 41*a* of the pair of conductor caulking pieces 41 through the bottom plate 40 to the other conductor caulking piece 41*b*. In addition, as shown in FIGS. 7 and 8, the serrations 46 are arranged in a zigzag pattern.

In this way, by arranging the serrations 46, which is formed in the circular shape, in the zigzag pattern, even if core wires of the conductor 2 formed by twisting a plurality of aluminum or aluminum alloy wires 3 together are excessively compressed, the core wires of the conductor 2 are not scarred by corners of the serrations 46 even when the aluminum electrical cable 1 is pulled by a certain cause so that a force is directly exerted on the conductor 2 of the aluminum electrical cable 1, thereby sufficiently and more effectively exhibiting the strain relief effect.

Although the serrations 25 and the serrations 46 have been described as being formed in a circular shape in the first embodiment shown in FIGS. 1 to 3 and the second embodiment shown in FIGS. 6 to 8, the serrations 25 and the serrations 46 may have an elliptical shape.

In addition, the present invention is not limited to the foregoing embodiments, but appropriate changes, modifications or the like thereof can be made.

What is claimed is:

1. A crimping structure of a conductive metal terminal in which the conductive metal terminal is connected to an aluminum electrical cable including a conductor formed by twisting a plurality of aluminum or aluminum alloy wires and a sheath made of an insulating material and covering on an outer circumference of the conductor, by crimping the conductive metal terminal on the aluminum electrical cable, the conductive metal terminal comprising:

a conductor holding part that holds the conductor of the aluminum electrical cable at a distal end side of the conductive metal terminal; and a sheath holding part that holds the sheath of the aluminum electrical cable at a proximal end side of the conductive metal terminal, wherein the conductor holding part includes a bottom plate on which the conductor of the aluminum electrical cable is placed and a pair of conductor crimping pieces provided to be continuous to the bottom plate and sandwich the conductor on the bottom plate of the conductor holding part, the sheath holding part includes a bottom plate adjacent to the bottom plate of the conductor holding part and on which the sheath is placed, and a pair of sheath crimping pieces provided to be continuous to the bottom plate of the sheath holding part and sandwich the sheath on the bottom plate of the sheath holding part, the conductor holding part further includes an indent on a sheath holding part side of the conductor holding part and having a semi-cylindrical shape extended along the indent and raised from an inner surface of the conductor holding part, the indent extending from one conductor crimping piece of the pair of conductor crimping pieces to another conductor crimping piece of the pair of conductor crimping pieces through the bottom plate of the conductor holding part and being raised perpendicular to an axis direction of the crimped conductor of the aluminum electrical cable, the conductor holding part further includes circular-shaped serrations on an upper surface of the bottom plate of the conductor holding part and on the pair of conductor crimping pieces, and the circular-shaped serrations are closer to the distal end side of the conductive metal terminal than the indent.

2. The crimping structure according to claim 1, wherein the conductor holding part further includes a second indent extending from one of the conductor holding part to the other of the conductor holding part through the bottom plate of the conductor holding part and being perpendicular to the axis direction of the crimped conductor of the aluminum electrical cable, and the circular-shaped serrations are disposed between the indent and the second indent.

3. The crimping structure according to claim 1, wherein the indent has a height being measured as a distance from a surface of the bottom plate to a peak of the indent having the semi-circular shape, the height of the indent is 0.03 mm to 0.08 mm.

4. The crimping structure according to claim 1, wherein the circular-shaped serrations are arranged in a zigzag pattern.

5. The crimping structure according to claim 2, wherein the second indent has a second height being measured as a distance from a surface of the bottom plate to a peak of the second indent having a semi-circular shape, the height of the second indent is 0.03 mm to 0.08 mm.

6. The crimping structure according to claim 1, wherein the indent inhibits a slip of the conductor and provides a strain relief effect of preventing a force from being exerted on the conductor when the aluminum electrical cable is pulled.

* * * * *